US011384443B2

(12) United States Patent
Zhang et al.

(10) Patent No.: US 11,384,443 B2
(45) Date of Patent: Jul. 12, 2022

(54) METHOD FOR PRODUCING METALLIC SILVER BY ELECTRO-DEPOSITION

(71) Applicant: INSTITUTE OF PROCESS ENGINEERING, CHINESE ACADEMY OF SCIENCES, Beijing (CN)

(72) Inventors: Hui Zhang, Beijing (CN); Tao Qi, Beijing (CN)

(73) Assignee: INSTITUTE OF PROCESS ENGINEERING, CHINESE ACADEMY OF SCIENCES, Beijing (CN)

( * ) Notice: Subject to any disclaimer, the term of this patent is extended or adjusted under 35 U.S.C. 154(b) by 156 days.

(21) Appl. No.: 16/652,991

(22) PCT Filed: Sep. 3, 2018

(86) PCT No.: PCT/CN2018/103810
§ 371 (c)(1),
(2) Date: Apr. 2, 2020

(87) PCT Pub. No.: WO2019/076151
PCT Pub. Date: Apr. 25, 2019

(65) Prior Publication Data

US 2020/0248325 A1 Aug. 6, 2020

(30) Foreign Application Priority Data

Oct. 16, 2017 (CN) ..... 201710958259.0
Aug. 9, 2018 (CN) ..... 201810901091.4

(51) Int. Cl.
*C25C 1/20* (2006.01)
*C25C 7/02* (2006.01)
*C25C 7/04* (2006.01)

(52) U.S. Cl.
CPC ..... *C25C 1/20* (2013.01); *C25C 7/02* (2013.01); *C25C 7/04* (2013.01)

(58) Field of Classification Search
CPC ..... C25C 1/12; C25C 1/20; C25D 3/46
See application file for complete search history.

(56) References Cited

U.S. PATENT DOCUMENTS 3,103,474 A * 9/1963 Juda ..... C23G 1/36 205/554
4,217,188 A * 8/1980 Ono ..... B01D 61/44 204/541
4,229,270 A * 10/1980 Subramanian ..... C22B 11/042 205/569
4,909,913 A * 3/1990 Fukuda ..... C08J 5/2237 204/296
5,389,212 A * 2/1995 McLaren ..... C25C 1/20 205/570
6,126,720 A * 10/2000 Okada ..... C25C 1/20 75/714

FOREIGN PATENT DOCUMENTS

CN 107674992 A * 2/2018 ..... C25C 1/20
EP 0198736 A * 10/1986 ..... C25B 1/00

OTHER PUBLICATIONS

Ren et al., Electrochemical oxidation of Ce(III) to Ce(IV) and deposition of copper powder in an electrolytic membrane reactor, Hydrometallurgy, vol. 103, Issue 1-4, Jun. 2010, pp. 205-210 (Year: 2010).*
Hoffman, James, The Hydrometallurgical Extraction and Recovery of High-Purity Silver, Metallurgical and Materials Transactions B, vol. 43B, Jun. 2012, pp. 431-439 (Year: 2012).*

* cited by examiner

*Primary Examiner* — Harry D Wilkins, III
(74) *Attorney, Agent, or Firm* — Bayramoglu Law Offices LLC

(57) ABSTRACT

A method for producing metallic silver by electro-deposition, including electrolyzing an electrolyte solution containing $Ce(NO_3)_3$ in an anode zone and an electrolyte solution containing $AgNO_3$ in a cathode zone by using an electrolytic cell with a specific diaphragm, wherein the electrolyte solution in the anode zone is not allowed to enter the cathode zone. After the electrolyzing is complete, the metallic silver with a high purity is obtained at the cathode, and a $Ce^{4+}$-containing solution is obtained in the anode zone.

13 Claims, No Drawings

METHOD FOR PRODUCING METALLIC SILVER BY ELECTRO-DEPOSITION

CROSS REFERENCE TO THE RELATED APPLICATIONS

This application is the national phase entry of International Application No. PCT/CN2018/103810, filed on Sep. 3, 2018, which is based upon and claims priority to Chinese Patent Applications No. 201710958259.0, filed on Oct. 16, 2017, and No. 201810901091.4, filed on Aug. 9, 2018, and the entire contents of which are incorporated herein by reference.

TECHNICAL FIELD

The present application relates to hydrometallurgical technology, and particularly to a method for producing metallic silver by electro-deposition.

BACKGROUND

Silver is the most conductive metal and can be made into wires, foils, coatings or electroconductive slurries. Silver is also an important chemical raw material and can be used as an active ingredient in photosensitizers and a variety of oxidation catalysts. Silver has become an indispensable raw material in modern industry, with global consumption reaching 31,000 tons in 2014. As a precious metal, the recovery of silver has significant economic value.

Due to the relatively high solubility of silver nitrate in water, silver-containing materials are generally leached by nitric acid, then silver is precipitated by using chloride ions as a precipitant and separated from other metals, and then the resulting silver chloride is reduced by a reductant such as hydrazine hydrate or glucose to obtain metallic silver. The problems with this method are as follows: 1) the reaction of nitric acid with silver will generate a large amount of nitrogen oxide gas; and 2) nitric acid, chloride, reductant, $NO_x$ exhaust gas absorbent and other reagents are used in the reaction process, which is not only costly, but also generates a large amount of waste liquid.

In order to solve the above problems, attempts have been made to recover metallic silver by electrolytic technology through putting silver-containing materials in an anode box for electrolytic reaction using nitric acid and silver nitrate as electrolytes to obtain metallic silver at a cathode. For example, CN101914785B discloses a method for recovering silver and copper from silver-copper alloy scraps by electrolysis through using a titanium plate as a cathode, loading the silver-copper alloy scraps into a titanium anode basket to form an anode, and using a silver nitrate solution as an electrolyte solution to recover electrolytic silver powder.

The problems with this method are as follows. 1) Since the solution can flow freely between the cathode and the anode, the anode substances may migrate to the cathode to affect the cathode reaction and products. In addition, the disordered and mixed flow of liquid between the cathode and the anode poses a huge obstacle to the optimization of the reaction system of the cathode and anode, because the optimization may eventually be at the cost of reduced current efficiency and product quality. 2) The direct electrolysis method is only suitable for materials with good conductivity. For materials with poor conductivity (such as catalysts containing silver and alumina support), if the anode zone is filled with the catalysts, with the progress of electrolysis, the silver content in the pores gradually decreases, and the insulating support (alumina, etc.) will prevent current from passing (increased resistance), resulting in increased voltage and increased power consumption. 3) For non-conductive silver-containing materials, it is difficult for the anode to directly contact the metallic silver in the pores due to the presence of the insulating support. Therefore, the surface of the anode actually undergoes water electrolysis to produce oxygen and nitric acid. Oxygen as the main product of the anode is exhausted into the air and wasted.

The literature "Progress in Silver Refining Technology" (Precious Metals, No. 2, 2005) discloses an application of an anion diaphragm electrolysis method in silver refining process, in which a silver electrolytic cell is divided into an anode zone and a cathode zone by an anion diaphragm to prevent the impurities in the anode zone from entering the cathode zone. However, because the anode constantly produces a large amount of anode slime and fine suspended slag, it is easy to adhere to the surface of the ion diaphragm, increasing the resistance, which leads to the increasing production cost of this method. It is necessary to clean or replace the diaphragm and the anode zone at regular intervals.

SUMMARY

The following is a summary of the subject matter described in detail herein. This summary is not intended to limit the protective scope of the claims.

The present application provides a method for producing metallic silver by electro-deposition whereby, the optimization of the electrolytic process in the cathode zone and the anode zone is achieved, the metallic silver and cerium(IV) nitrate are efficiently obtained, the electrochemical reaction of the cathode and the anode is realized, and at the same time, valuable products are produced, thereby improving economic benefits.

In a first aspect, the present application provides a method for producing metallic silver by electro-deposition, including electrolyzing an electrolyte solution containing $Ce(NO_3)_3$ in an anode zone and an electrolyte solution containing $AgNO_3$ in a cathode zone by using an electrolytic cell with an anion exchange membrane, wherein the electrolyte solution in the cathode zone and the electrolyte solution in the anode zone are not in fluid communication with each other. After the electrolyzing is complete, the metallic silver is obtained at the cathode, and a solution containing $Ce^{4+}$ is obtained in the anode zone.

During the electrolyzing, if $Ce^{4+}$ generated in the anode zone enters the cathode zone, current efficiency of the cathode will be significantly affected. In the present application, the anion exchange membrane is used to hinder the fluid communication between the electrolyte solution in the cathode zone and the electrolyte solution in the anode zone, and thus $Ce^{4+}$ generated in the anode zone can be prevented from entering the cathode zone, thereby avoiding the above effects.

In a second aspect, the present application provides another method for producing metallic silver by electro-deposition, including electrolyzing an electrolyte solution containing $Ce(NO_3)_3$ in an anode zone and an electrolyte solution containing $AgNO_3$ in a cathode zone by using an electrolytic cell with a diaphragm, wherein the diaphragm includes any one of an anion exchange membrane, a membrane with micropores or a membrane with nanopores, and only unidirectional flow of the electrolyte solution in the cathode zone to the anode zone is permitted. After the electrolyzing is complete, the metallic silver is obtained at the cathode, and a solution containing $Ce^{4+}$ is obtained in the anode zone.

In this case, the first method is to use the anion exchange membrane, which can not only prevent $Ce^{4+}$ diffusion from the anode zone to the cathode zone, but can also carry current and maintain the electrolyzing by the unidirectional flow of the electrolyte solution and by the anion permeability characteristics of the membrane. The second method is to use a porous membrane (including a membrane with micropores and a membrane with nanopores). The large number of pores in the membrane allow a large amount of $NO_3^-$ anions (and a certain amount of cations) excessively remaining in the cathode zone due to the electro-deposition of $AgNO_3$, to enter the anode zone through the pores in the membrane, thereby carrying current and maintaining the electrolyzing. Moreover, the unidirectional flow of the electrolyte solution can prevent $Ce^{4+}$ in the anode zone from diffusing into the cathode zone.

The membrane with micropores and the membrane with nanopores mentioned in the present application refer to simple porous membranes with a pore diameter of 100 microns or less (without ionizable ionic groups), which can allow the solution to pass under a certain pressure, including but not limited to microporous membranes and nanofiltration membranes for water treatment, and microporous separators for batteries.

The reaction raw materials and products of the anode in the present application are soluble substances with extremely high solubility, which are stable in nature and have no waste residue, thereby having little impact on the electrolysis process, and making it unnecessary to clean or replace the diaphragm frequently. More importantly, in the related art, the anode reaction of silver refining consumes current without generating value, while in the present application, a double benefit of the cathode reaction and the anode reaction is creatively realized through the specially selected anode reaction and electrolysis system.

The present inventors have tested and screened various electrolyte solution systems, and finally found that only the cerium nitrate system is suitable. Cerium is non-toxic and cheap. The solubility of cerium nitrate in aqueous solution is very high (the solubility of cerium sulfate is only about 10 g). The reduction potential of $Ce^{3+}$ is significantly lower than that of $Ag^+$, so $Ce^{3+}$ will not be reduced to metal. The precipitation pH of $Ce^{3+}$ is very different from that of $Ag^+$, so $Ce^{3+}$ can be easily separated. The product generated from the oxidation of $Ce^{3+}$ to $Ce^{4+}$ is single and easy to separate, and the oxidation itself also achieves a benefit. Moreover, silver ions are not oxidized at the anode, and they also have the characteristics of catalyzing the electrochemical oxidation reaction of $Ce^{3+}$.

Based on the above reasons, the method for producing metallic silver in the present application has a high application value.

Optionally, enabling the electrolyte solution in the cathode zone to unidirectionally flow only to the anode zone is carried out by means including providing pressure or overflow. The unidirectional flow of the electrolyte solution from the cathode zone to the anode zone is achieved by several alternatives, such as overflow or through the pores in the membrane under a pressure difference, to prevent $Ce^{4+}$ in the anode zone from diffusing into the cathode zone.

Optionally, the electrolyte solution in the anode zone contains silver ions. The presence of silver ions can catalyze the electrooxidation reaction of $Ce^{3+}$.

Optionally, the electrolyte solution in the anode zone described in the present application has $[H^+]$ of greater than or equal to 0.01 mol/L. For example, the $[H^+]$ may be at 0.01 mol/L, 0.1 mol/L, 0.5 mol/L, 1 mol/L, 1.5 mol/L, 2 mol/L or the like. Due to space limitations and for the sake of brevity, the present application is not exhaustive.

Optionally, the electrolyte solution in the anode zone described in the present application has $[H^+]$ greater than or equal to 0.1 mol/L.

Optionally, the electrolyte solution in the cathode zone described in the present application has $[Ag^+]$ of greater than or equal to 0.5 mol/L. For example, the $[Ag^+]$ may be at 0.5 mol/L, 0.7 mol/L, 0.9 mol/L, 1 mol/L, 1.5 mol/L, 2 mol/L or more. Due to space limitations and for the sake of brevity, the present application is not exhaustive.

Optionally, the electrolyte solution in the cathode zone described in the present application has $[Ag^+]$ of greater than or equal to 0.9 mol/L.

Optionally, the electrolyte solution in the cathode zone described in the present application has $[H^+]$ of less than or equal to 0.1 mol/L. For example, the $[H^+]$ may be at 0.001 mol/L, 0.005 mol/L, 0.01 mol/L, 0.03 mol/L, 0.05 mol/L, 0.1 mol/L or less, or alternatively specific point values between the above values. Due to space limitations and for the sake of brevity, the present application is not exhaustive.

In the present application, by controlling composition and content of the electrolyte solution in the anode zone and the electrolyte solution in the cathode zone, the electrochemical reactions at the cathode and the anode can be optimized, thereby improving production efficiency.

Optionally, the electrolyte solution in the cathode zone has Ce at a concentration of less than or equal to 0.2 mol/L. For example, Ce may be at a concentration of 0 mol/L, 0.001 mol/L, 0.005 mol/L, 0.01 mol/L, 0.02 mol/L, 0.05 mol/L, 0.1 mol/L or 0.2 mol/L, or alternatively specific point values between the above values. Due to space limitations and for the sake of brevity, the present application is not exhaustive.

Optionally, the cathode during the electrolyzing has a current density ranging from 100 $A/m^2$ to 650 $A/m^2$. For example, the current density may be 100 $A/m^2$, 150 $A/m^2$, 200 $A/m^2$, 250 $A/m^2$, 300 $A/m^2$, 350 $A/m^2$, 400 $A/m^2$, 450 $A/m^2$, 500 $A/m^2$, 550 $A/m^2$, 600 $A/m^2$ or 650 $A/m^2$, or alternatively specific point values between the above values. Due to space limitations and for the sake of brevity, the present application is not exhaustive.

In the present application, by preventing disordered flow between the electrolyte solution in the anode zone and the electrolyte solution in the cathode zone, separate regulation and optimization of the cathode reaction and the anode reaction are achieved. By controlling the composition and content of the electrolyte solution in the anode zone and the electrolyte solution in the cathode zone, the electrochemical reactions at the cathode and the anode can be optimized, thereby improving the production efficiency. Nitrate systems with high solubility can also support higher current density and production efficiency than sulfate systems.

Compared with the related art, the present application has the advantages as follows.

(1) In the present application, the anion exchange membrane is used to block the passage of cations from the anode zone to the cathode zone, reducing the influence of the electrolyte solution in the anode zone on the electroreduction process of cathode, which is beneficial in obtaining metallic silver products with higher purity.

(2) In the present application, by preventing the disordered flow between the electrolyte solution in the anode zone and the electrolyte solution in the cathode zone, the regulation and optimization of the cathode reaction and the anode reaction are achieved, and the current efficiency is improved. The current efficiency of preparing metallic silver by electrolysis is greater than or equal to 80%, and the current efficiency of preparing $Ce^{4+}$ is greater than or equal to 80%.

(3) The silver ions in the anode zone can catalyze the electrooxidation reaction of $Ce^{3+}$, which is beneficial in reducing the production cost.

(4) In the present application, cerium(IV) nitrate and metallic silver are obtained simultaneously by electrolysis. On the one hand, because $Ag^+/Ag$ potential is higher than $H^+/H_2$ potential during the cathode reaction, compared with the traditional reaction of electrolyzing cerium (III) nitrate to prepare cerium (IV) nitrate, the preparation cost can be reduced. On the other hand, compared with the valueless oxygen evolution reaction that occurs at the anode during the traditional silver nitrate electro-deposition process, in the present application, the anode reaction is changed to the preparation of cerium(IV) nitrate, which improves the economic benefits.

(5) Through the method of the present application, two products are prepared at the same time, the process is efficient and environmentally friendly, and no exhaust gas and acid mist are emitted, no waste residue is generated, so frequent cleaning or replacement of diaphragm is not required.

After reading and understanding the detailed description, other aspects can be understood.

DETAILED DESCRIPTION OF THE EMBODIMENTS

In order to facilitate understanding of the present application, the present application lists embodiments as follows. Those skilled in the art should understand that the embodiments are intended merely to help understand the present application and should not be considered as a specific limitation to the present application.

Embodiment 1

An electrolytic cell was divided into a cathode zone and an anode zone by an anion exchange membrane, a platinum-plated titanium mesh was used as the anode, and a silver plate was used as the cathode. The current density of the cathode was controlled to 400 $A/m^2$ for electrolysis. The initial solution in the cathode zone was 0.5 mol/L $AgNO_3$ neutral solution, and the initial solution in the anode zone contained 0.5 mol/L $Ce(NO_3)_3$, 0.01 mol/L $H^+$ and 0.01 mol/L $AgNO_3$.

0.8 mol/L $AgNO_3$ neutral solution was continuously added into the cathode zone as the electrolyte solution in the cathode zone. By controlling the liquid level, the solution in the cathode zone was enabled to overflow the membrane and slowly flow into the anode zone. A solution containing 0.5 mol/L $Ce(NO_3)_3$ and 0.1 mol/L $HNO_3$ was added to the anode zone as the electrolyte solution in the anode zone as required. During the electrolysis, the solution in the cathode zone was maintained at $[Ag^+]\geq 0.5$ mol/L and $[H^+]\leq 0.1$ mol/L, and the solution in the anode zone was maintained at $[H^+]\geq 0.01$ mol/L by timely supplementing the corresponding raw materials.

$Ag^+$ was reduced to metallic silver on the silver plate cathode, and $Ce^{3+}$ was converted to $Ce(NO_3)_4$ by oxidation reaction at the anode, and the produced $Ce(NO_3)_4$ was timely removed. A part of nitrate required for the anode was supplemented by $NO_3^-$ in the cathode zone passing through the anion exchange membrane, and the other part was supplemented by the solution at the cathode that overflowed.

It was detected that the purity of the metallic silver obtained at the cathode reached 5N grade, the current efficiency of the cathode was 80%, and the current efficiency of the anode was 87%.

Embodiment 2

An electrolytic cell was divided into a cathode zone and an anode zone by a porous membrane with a pore diameter of 100 micronss or less, a platinum sheet was used as the anode, and a titanium mesh was used as the cathode. The current density of the cathode was controlled to 100 $A/m^2$ for electrolysis. The initial solution in the cathode zone was 1.5 mol/L $AgNO_3$ solution having $[H^+]$ of 0.01 mol/L. The initial solution in the anode zone contained 0.2 mol/L $Ce(NO_3)_3$ and 0.1 mol/L $H^+$.

1.5 mol/L $AgNO_3$ neutral solution was continuously added into the cathode zone as the electrolyte solution in the cathode zone. By controlling the liquid level, the solution in the cathode zone was enabled to slowly flow into the anode zone through the pores in the membrane. A solution containing 0.5 mol/L $Ce(NO_3)_3$ and 0.1 mol/L $HNO_3$ was added to the anode zone as the electrolyte solution in the anode zone as required. During the electrolysis, the solution in the cathode zone was maintained at $[Ag^+]\geq 0.5$ mol/L and $[H^+]\leq 0.1$ mol/L, and the solution in the anode zone was maintained at $[H^+]\geq 0.1$ mol/L by timely supplementing the corresponding raw materials.

$Ag^+$ was reduced to metallic silver on the cathode, and $Ce^{3+}$ was converted to $Ce(NO_3)_4$ by oxidation reaction at the anode, and the produced $Ce(NO_3)_4$ was timely removed. A part of nitrate required for the anode was supplemented by $NO_3^-$ in the cathode zone passing through the anion exchange membrane, and the other part was supplemented by the solution at the cathode that passed through the membrane.

It was detected that the purity of the metallic silver obtained at the cathode reached 5N grade, the current efficiency of the cathode was 95%, and the current efficiency of the anode was 80%.

Embodiment 3

An electrolytic cell was divided into a cathode zone and an anode zone by a nanofiltration membrane, a platinum mesh was used as the anode, and a silver plate was used as the cathode. The current density of the cathode was controlled to 650 $A/m^2$ for electrolysis. The initial solution in the cathode zone was 1.5 mol/L $AgNO_3$ solution having $[H^+]$ of 0.05 mol/L and further containing 0.1 mol/L $Ce(NO_3)_3$. The initial solution in the anode zone contained 2 mol/L $Ce(NO_3)_3$, 1 mol/L $H^+$ and 1 mol/L $AgNO_3$.

A solution containing $Ce(NO_3)_3$ was added into the closed anode zone through a pipeline for electrolysis, and a solution containing $Ce^{4+}$ was output through a pipeline. A certain negative pressure was applied to the closed anode zone. Due to the pressure difference, only ions and water molecules in the cathode zone were allowed to enter the anode zone through the membrane. A solution containing $AgNO_3$ was continuously added to the cathode zone as the electrolyte solution in the cathode zone. During the electrolysis, the solution in the cathode zone was maintained at $[Ag^+]\geq 0.5$ mol/L and $[H^+]\leq 0.1$ mol/L, and the solution in the anode zone was maintained at $[H^+]\geq 0.1$ mol/L by timely supplementing or removing the corresponding components.

$Ag^+$ was reduced to metallic silver on the silver plate cathode, and $Ce^{3+}$ was converted to $Ce(NO_3)_4$ by oxidation reaction at the anode, and the produced $Ce(NO_3)_4$ was removed timely.

It was detected that the purity of the metallic silver obtained at the cathode reached 5N grade, the current efficiency of the cathode was 95%, and the current efficiency of the anode was 80%.

Embodiment 4

An electrolytic cell was divided into a cathode zone and an anode zone by an anion exchange membrane, and a platinum mesh was used as the anode, and a silver plate was used as the cathode. The electrolyte solution in the cathode zone and the electrolyte solution in the anode zone were prevented from fluid communication with each other. The current density of the cathode was controlled to 350 A/m$^2$ for electrolysis. The initial solution in the cathode zone was 1.5 mol/L $AgNO_3$ solution at pH 2, and the initial solution in the anode zone contained 1 mol/L $Ce(NO_3)_3$ and 0.01 mol/L $H^+$.

The electrolysis was performed by applying direct current, and the electrolysis was stopped when [$Ag^+$] in the electrolyte solution in the cathode zone decreased to 0.9 mol/L. $Ag^+$ was reduced on the silver plate cathode to obtain metallic silver, and $Ce(NO_3)_3$ was converted to $Ce(NO_3)_4$ by oxidation reaction at the anode. Nitrate required for the anode was supplemented by $NO_3^-$ in the cathode zone passing through the anion exchange membrane.

It was detected that the purity of the metallic silver obtained at the cathode reached 5N grade, the reduction current efficiency of the cathode was 98%, and the oxidation current efficiency of the anode was 97%.

Embodiment 5

An electrolytic cell was divided into a cathode zone and an anode zone by an anion exchange membrane. The electrolyte solution in the cathode zone and the electrolyte solution in the anode zone were prevented from fluid communication with each other. The electrolyte solution in the cathode zone contained 0.1 mol/L acetic acid and 2 mol/L $AgNO_3$, and the electrolyte solution in the anode zone contained 1 mol/L $Ce(NO_3)_3$, 0.01 mol/L $AgNO_3$ and 1 mol/L $HNO_3$. A platinum sheet was used as the anode, and a titanium mesh was used as the cathode. The current density of the cathode was controlled to 650 A/m$^2$ for electrolysis. During the electrolysis, the cathode zone and the anode zone were continuously supplemented with the solutions with the above-mentioned compositions individually as needed, and the excess solutions were individually discharged from the electrolytic cell through overflow ports. $Ag^+$ was reduced on the titanium mesh to obtain metallic silver, and $Ce(NO_3)_4$ solution was obtained at the anode.

It was detected that the purity of the metallic silver obtained at the cathode reached 5N grade, the current efficiency of the cathode was greater than 90%, and the current efficiency of the anode was greater than 90%.

Embodiment 6

An electrolytic cell was divided into a cathode zone and an anode zone by an anion exchange membrane. The electrolyte solution in the cathode zone and the electrolyte solution in the anode zone were prevented from fluid communication with each other. A neutral solution containing 0.5 mol/L $AgNO_3$ was added into the cathode zone as the electrolyte solution in the cathode zone. The electrolyte solution in the anode zone contained 0.5 mol/L $Ce(NO_3)_3$ and 0.1 mol/L $HNO_3$. A graphite plate was used as the anode, and a titanium mesh was used as the cathode. The current density of the cathode was controlled to 100 A/m$^2$ for electrolysis. During the electrolysis, the cathode zone was continuously supplemented with 0.55 mol/L $AgNO_3$ solution, and the excess electrolyte solution in the cathode zone was discharged into a storage tank through an overflow port. The solution in the storage tank was taken into a new storage tank, followed by adding concentrated nitric acid and solid $Ce(NO_3)_3$ to prepare a solution containing 0.5 mol/L $Ce(NO_3)_3$ and 0.1 mol/L $HNO_3$, and then the anode zone was supplemented with the solution as the electrolyte solution in the anode zone. $Ce(NO_3)_4$ produced in the anode zone was pumped out intermittently by a pump.

It was detected that the purity of the metallic silver obtained at the cathode reached 4N grade.

Embodiment 7

An electrolytic cell was divided into a cathode zone and an anode zone by an anion exchange membrane. A solution containing 0.5 mol/L $AgNO_3$ and 0.1 mol/L $HNO_3$ was added into the cathode zone as the electrolyte solution in the cathode zone. The electrolyte solution in the anode zone contained 0.5 mol/L $Ce(NO_3)_3$ and 0.1 mol/L $HNO_3$. A platinum mesh was used as the anode and a silver mesh was used as the cathode. The current density of the cathode was controlled to 100 A/m$^2$ for electrolysis. During the electrolysis, $AgNO_3$ solution at a high concentration was continuously added to the cathode zone. Due to the difference in the liquid level between the cathode and anode, the electrolyte solution in the cathode zone was enabled to enter the anode zone through small holes in the cathode frame or the anode frame. The small holes had a size that did not allow the anolyte to counterflow into the cathode zone. The anode zone was continuously supplemented with $Ce(NO_3)_3$ solution at a high concentration, and $Ce(NO_3)_4$ produced was pumped out by a pump.

It was detected that the purity of the metallic silver obtained at the cathode reached 5N grade, and the current efficiency was greater than or equal to 90%.

Embodiment 8

An electrolytic cell was divided into a cathode zone and an anode zone by an anion diaphragm. The cathode zone and the anode zone were prevented from direct fluid communication with each other. A saturated $AgNO_3$ solution at room temperature was added into the cathode zone as the catholyte, and a saturated $Ce(NO_3)_3$ solution containing 2 mol/L $HNO_3$ was added into the anode zone as the anolyte. A platinum mesh was used as the anode, a titanium mesh was used as the cathode, and the current density of the cathode was controlled to 100 A/m$^2$ for electrolysis. During the electrolysis, the concentration of $Ag^+$ was controlled to ≥0.9 mol/L, the concentration of $H^+$ was controlled to ≤0.1 mol/L, and the concentration of Ce was controlled to ≤0.2 mol/L in the solution in the cathode zone, and the concentration of in the solution in the anode zone was controlled to ≥0.1 mol/L. $Ag^+$ was reduced on the titanium mesh to obtain metallic silver. The solution in the cathode zone and the solution in the anode zone each flowed independently. The catholyte in the cathode zone maintained the composition and concentration requirements by continuously supplementing with the saturated $AgNO_3$ solution. At the same time, fresh anolyte was timely added to the anolyte, and $Ce(NO_3)_4$ solution produced at the anode eventually flowed out from an overflow port.

It was detected that the purity of the metallic silver obtained at the cathode exceeded 99.99%, which met 1 # silver standard in GB standards, and the current efficiency was 98%.

Embodiment 9

An electrolytic cell was divided into a cathode zone and an anode zone by an anion diaphragm. The cathode zone and the anode zone were prevented from direct fluid communication with each other. A solution containing 0.1 mol/L $HNO_3$ and 0.9 mol/L $AgNO_3$ was added into the cathode zone as the catholyte, and a solution containing 0.2 mol/L $Ce(NO_3)_3$, 0.5 mol/L $H^+$ and 0.01 mol/L $AgNO_3$ was added into the anode zone as the anolyte. A platinum mesh was used as the anode, a silver plate was used as the cathode, and the current density of the cathode was controlled to 500 $A/m^2$ for electrolysis. During the electrolysis, the solution in the cathode zone was controlled to maintain the following conditions: the concentration of $Ag^+ \geq 0.9$ mol/L, the concentration of $H^+ \leq 0.1$ mol/L, and the concentration of $Ce \leq 0.2$ mol/L, and the concentration of $H^+$ in the solution in the anode zone was controlled to ≥0.1 mol/L. $Ag^+$ was reduced on the silver plate to obtain metallic silver, and $Ce^{3+}$ was converted to $Ce(NO_3)_4$ by oxidation reaction at the anode. Nitrate required for the anode was supplemented by $NO_3^-$ in the cathode zone passing through the anion diaphragm. The solution in the cathode zone and the solution in the anode zone were supplemented and removed separately. The catholyte in the cathode zone was maintained to meet the composition and concentration requirements by continuously supplementing with the concentrated $AgNO_3$ solution. At the same time, the anolyte was supplemented with $Ce(NO_3)_3$, and the produced $Ce(NO_3)_4$ was removed timely.

It was detected that the purity of the metallic silver obtained at the cathode reached 5N grade, and the current efficiency was 80%.

Embodiment 10

An electrolytic cell was divided into a cathode zone and an anode zone by an anion diaphragm. The cathode zone and the anode zone were prevented from direct fluid communication with each other. A solution containing 2 mol/L $AgNO_3$, 0.2 mol/L $Ce(NO_3)_3$ and 0.01 mol/L $H^+$ was added into the cathode zone as the catholyte, and a solution containing 1 mol/L $Ce(NO_3)_3$, 0.01 mol/L $AgNO_3$ and 1 mol/L $HNO_3$ was added into the anode zone as the anolyte. A platinum sheet was used as the anode, a titanium mesh was used as the cathode, and the current density of the cathode was controlled to 650 $A/m^2$ for electrolysis. During the electrolysis, the concentration of $Ag^+$ was controlled to ≥1.8 mol/L, the concentration of $H^+$ was controlled to ≤0.1 mol/L, and the concentration of Ce was controlled to ≤0.2 mol/L in the solution in the cathode zone, and the concentration of in the solution in the anode zone was controlled to ≥0.1 mol/L. $Ag^+$ was reduced on the titanium mesh to obtain metallic silver, and $Ce^{3+}$ was converted to $Ce(NO_3)_4$ by oxidation reaction at the anode. The solution in the cathode zone and the solution in the anode zone each flowed independently. The catholyte in the cathode zone was maintained to meet the composition and concentration requirements by continuously supplementing with the $AgNO_3$ solution. At the same time, the anolyte was supplemented with $Ce(NO_3)_3$, and $Ce(NO_3)_4$ in the solution was removed timely.

It was detected that the purity of the metallic silver obtained at the cathode met 1 # silver standard in GB standards, and the current efficiency was 95%.

Embodiment 11

An electrolytic cell was divided into a cathode zone and an anode zone by an anion diaphragm. The cathode zone and the anode zone were prevented from direct fluid communication with each other. A solution containing 1 mol/L $AgNO_3$ and 0.1 mol/L $Ce(NO_3)_3$ was added into the cathode zone as the catholyte, and a solution containing 0.5 mol/L $Ce(NO_3)_3$ and 0.1 mol/L was added into the anode zone as the anolyte. A graphite plate was used as the anode, a titanium mesh was used as the cathode, and the current density of the cathode was controlled to 200 $A/m^2$ for electrolysis. During the electrolysis, the concentration of $Ag^+$ was controlled to ≥0.9 mol/L, the concentration of $H^+$ was controlled to ≤0.1 mol/L, and the concentration of Ce was controlled to ≤0.2 mol/L in the solution in the cathode zone, and the concentration of in the solution in the anode zone was controlled to ≥0.1 mol/L. $Ag^+$ was reduced on the titanium mesh to obtain metallic silver, and $Ce(NO_3)_4$ was obtained by oxidation reaction at the anode. The solution in the cathode zone and the solution in the anode zone each flowed independently. The catholyte in the cathode zone was maintained to meet the composition and concentration requirements by adding $AgNO_3$. At the same time, the anolyte was supplemented with $Ce(NO_3)_3$ and $HNO_3$, and $Ce(NO_3)_4$ was removed timely.

It was detected that the purity of the metallic silver obtained at the cathode met 1 # silver standard in GB standards, and the current efficiency was 93%. The $Ce(NO_3)_4$ produced in the anolyte was directly used as an oxidant for etching circuit boards.

Comparative Example 1

An electrolytic cell was divided into a cathode zone and an anode zone by a conventional filter cloth. The solutions and ions in the cathode and anode zones were allowed to diffuse and flow freely. Both the electrolyte solutions at the cathode and anode contained 1 mol/L $AgNO_3$, 1.5 mol/L $Ce(NO_3)_3$ and 0.5 mol/L $HNO_3$. A platinum mesh was used as the anode and a titanium mesh was used as the cathode. The current density of the cathode was controlled to 400 $A/m^2$ for electrolysis. $Ag^+$ was reduced on the titanium mesh to obtain metallic silver, and $Ce^{3+}$ was converted to $Ce(NO_3)_4$ by oxidation reaction at the anode. With the progress of electrolysis, the upper part of the anode zone showed a clear red color ($Ce^{4+}$), and the red color diffused through the filter cloth into the cathode zone, and the $Ce^{4+}$ was reduced on the surface of the cathode (the red color disappeared).

It was detected that the purity of the metallic silver obtained at the cathode was 99.95%, which did not meet 1 # silver standard in GB standards. Since $Ce^{4+}$ produced at the anode diffused to the cathode and was reduced preferentially over $Ag^+$, the current efficiency of the silver reduction at the cathode was 12%, which was significantly lower than the method of the present application.

Applicant declares that in the present application, the above embodiments are used to describe the process flow of the present application, but the present application is not limited to the above-mentioned process flow. That is, it does not mean that the present application must rely on the above-mentioned specific process flow to be implemented.

What is claimed is:

1. A method for producing metallic silver by electrodeposition, comprising electrolyzing an electrolyte solution containing $Ce(NO_3)_3$ in an anode zone and an electrolyte solution containing $AgNO_3$ in a cathode zone by using an electrolytic cell with an anion exchange membrane, wherein the electrolyte solution in the cathode zone and the electrolyte solution in the anode zone are not in fluid communication with each other, and after the electrolyzing is complete, the metallic silver is obtained at a cathode of the electrolytic cell, and a solution containing $Ce^{4+}$ is obtained in the anode zone, wherein the electrolyte solution in the cathode zone has $H^+$ at a concentration of no more than 0.1 mol/L.

2. The method according to claim 1, wherein the electrolyte solution in the anode zone has $H^+$ at a concentration of at least 0.01 mol/L.

3. The method according to claim 1, wherein the electrolyte solution in the anode zone has $H^+$ at a concentration of at least 0.1 mol/L.

4. The method according to claim 1, wherein the electrolyte solution in the cathode zone has $Ag^+$ at a concentration of at least 0.5 mol/L.

5. The method according to claim 1, wherein the electrolyte solution in the cathode zone has $Ag^+$ at a concentration of at least 0.9 mol/L.

6. The method according to claim 1, wherein the electrolyte solution in the cathode zone has Ce at a concentration of no more than 0.2 mol/L.

7. The method according to claim 1, wherein the cathode during the electrolyzing has a current density ranging from 100 to 650 $A/m^2$.

8. A method for producing metallic silver by electrodeposition, comprising electrolyzing an electrolyte solution containing $Ce(NO_3)_3$ in an anode zone and an electrolyte solution containing $AgNO_3$ in a cathode zone by using an electrolytic cell with a diaphragm, wherein the diaphragm is one selected from the group consisting of an anion exchange membrane, a membrane with micropores and a membrane with nanopores, wherein only a unidirectional flow of the electrolyte solution in the cathode zone to the anode zone is enabled, and after the electrolyzing is complete, the metallic silver is obtained at a cathode of the electrolytic cell, and a solution containing $Ce^{4+}$ is obtained in the anode zone, wherein the unidirectional flow is carried out by means comprising providing at least one of pressure and overflow.

9. The method according to claim 8, wherein the electrolyte solution in the anode zone contains silver ions.

10. The method according to claim 8, wherein the electrolyte solution in the anode zone has $H^+$ at a concentration of at least 0.01 mol/L.

11. The method according to claim 8, wherein the electrolyte solution in the cathode zone has $Ag^+$ at a concentration of at least 0.5 mol/L.

12. The method according to claim 8, wherein the cathode during the electrolyzing has a current density ranging from 100 to 650 $A/m^2$.

13. A method for producing metallic silver by electrodeposition, comprising electrolyzing an electrolyte solution containing $Ce(NO_3)_3$ in an anode zone and an electrolyte solution containing $AgNO_3$ in a cathode zone by using an electrolytic cell with an anion exchange membrane, wherein the electrolyte solution in the cathode zone and the electrolyte solution in the anode zone are not in fluid communication with each other, and after the electrolyzing is complete, the metallic silver is obtained at a cathode of the electrolytic cell, and a solution containing $Ce^{4+}$ is obtained in the anode zone, wherein the electrolyte solution in the anode zone contains silver ions.

* * * * *